US010074471B2

(12) United States Patent
Sakai et al.

(10) Patent No.: US 10,074,471 B2
(45) Date of Patent: Sep. 11, 2018

(54) MAGNETIC ELEMENT

(71) Applicant: NTN CORPORATION, Osaka (JP)

(72) Inventors: Kayo Sakai, Mie (JP); Eiichirou Shimazu, Mie (JP); Shinji Miyazaki, Mie (JP); Takayuki Oda, Mie (JP)

(73) Assignee: NTN CORPORATION, Osaka (JP)

( * ) Notice: Subject to any disclaimer, the term of this patent is extended or adjusted under 35 U.S.C. 154(b) by 0 days.

(21) Appl. No.: 15/128,893

(22) PCT Filed: Mar. 18, 2015

(86) PCT No.: PCT/JP2015/058016
§ 371 (c)(1),
(2) Date: Sep. 23, 2016

(87) PCT Pub. No.: WO2015/146739
PCT Pub. Date: Oct. 1, 2015

(65) Prior Publication Data

US 2017/0110233 A1 Apr. 20, 2017

(30) Foreign Application Priority Data

Mar. 24, 2014 (JP) ..... 2014-060578

(51) Int. Cl.
*H01F 27/02* (2006.01)
*H01F 27/255* (2006.01)
(Continued)

(52) U.S. Cl.
CPC ..... *H01F 27/255* (2013.01); *H01F 3/10* (2013.01); *H01F 27/2823* (2013.01);
(Continued)

(58) Field of Classification Search
CPC ..... H01F 3/08
(Continued)

(56) References Cited

U.S. PATENT DOCUMENTS 8,466,764 B2 * 6/2013 Bogert ..... H01F 5/003 336/83
2010/0253455 A1 * 10/2010 Wolf ..... H01F 38/12 336/83
(Continued)

FOREIGN PATENT DOCUMENTS

CN 102782780 A 11/2012
CN 102810386 A 12/2012
(Continued)

OTHER PUBLICATIONS

International Search Report for PCT/JP2015/058016 dated Jun. 9, 2015.
English Abstract for CN 102810386 A dated Dec. 5, 2012.

*Primary Examiner* — Ronald Hinson
(74) *Attorney, Agent, or Firm* — Hedman & Costigan, P.C.; James V. Costigan; Kathleen A. Costigan

(57) ABSTRACT

The present invention provides a magnetic element in which iron loss-caused heat generation is restrained and which can be produced with a high productivity. The magnetic element has a magnetic body which allows a magnetic flux generated by a coil (4) to pass therethrough. The magnetic body is a combined body formed by combining two halves, of the magnetic body composed of the compression molded and injection molded bodies, obtained by bisection made in an axial direction of the coil with each other. A compression molded magnetic body (2) is disposed at a portion generating iron loss-caused heat to a high extent or a portion inferior in heat dissipation performance. An injection molded magnetic body (3) is disposed at a portion other than the portion where the compression molded magnetic body is disposed. The compression molded and injection molded magnetic bodies are combined with each other.

5 Claims, 8 Drawing Sheets

(a)

(b)

(51) Int. Cl.

| | |
|---|---|
| ***H01F 3/10*** | (2006.01) |
| ***H01F 37/00*** | (2006.01) |
| ***H01F 27/28*** | (2006.01) |
| *H01F 17/04* | (2006.01) |
| *H01F 1/147* | (2006.01) |

(52) U.S. Cl.
CPC ..... *H01F 37/00* (2013.01); *H01F 1/14733* (2013.01); *H01F 1/14791* (2013.01); *H01F 17/043* (2013.01); *H01F 2003/106* (2013.01)

(58) Field of Classification Search
USPC ..... 336/83
See application file for complete search history.

(56) References Cited

U.S. PATENT DOCUMENTS

2012/0326829 A1 12/2012 Matsuda
2014/0241011 A1* 8/2014 Nomura ..... H01F 27/22 363/13
2015/0022301 A1* 1/2015 Esaki ..... H01F 1/26 336/83
2016/0155566 A1* 6/2016 Yoon ..... H01F 1/14741 336/233

FOREIGN PATENT DOCUMENTS

| | | | |
|---|---|---|---|
| EP | 2551860 | A1 | 1/2013 |
| JP | 2000-269039 | A | 9/2000 |
| JP | 2002-057039 | A | 2/2002 |
| JP | 2008-085004 | A | 4/2008 |
| JP | 2008-112935 | A | 5/2008 |
| JP | 2009-033051 | A | 2/2009 |
| JP | 4763609 | B2 | 8/2011 |
| JP | 2014-027050 | A | 2/2014 |
| JP | 2014-209579 | A | 11/2014 |
| KR | 10-2012-0112841 | A | 10/2012 |
| SG | 183303 | A1 | 9/2012 |
| WO | 2011/118004 | A1 | 9/2011 |
| WO | 2014/017512 | A1 | 1/2014 |
| WO | 2014/156770 | A1 | 10/2014 |

* cited by examiner

MAGNETIC ELEMENT

TECHNICAL FIELD

The present invention relates to a magnetic element consisting of a coil wound around the circumference of a magnetic body. The present invention relates particularly to a magnetic element for use in electrical or electronic equipment as an inductor, a transformer, an antenna (bar antenna), a choke coil, a filter, a sensor, and the like.

BACKGROUND ART

In recent years, in the prevailing trend toward the application of a large electric current having higher frequencies to circuits of electrical and electronic equipment, not only the electrical and electronic equipment but also the magnetic element is required to follow the trend. But the characteristic of a ferrite material which presently prevails as the magnetic body has reached the limit. Consequently new magnetic materials are being searched for. For example, the ferrite material is being replaced with a compression molded magnetic material such as sendust and an amorphous material; and an amorphous foil band. But the compression molded magnetic material has a poor moldability and a low mechanical strength after the compression molded magnetic material is fired. The production cost of the amorphous foil band is high because it is produced through winding, cutting, and gap forming processes. For these reasons, practical applications of these magnetic materials have been delayed.

Aiming at providing a method of producing a magnetic core component which has a variety of configurations and characteristics, is compact, and is inexpensive by using magnetic powder having a low moldability, the present applicant proposed a method of producing the core component having a predetermined magnetic characteristic by performing injection molding. The core component is composed of the compression molded magnetic body or the compressed powder magnet molded body containing a binding agent having a melting point lower than the injection molding temperature thereof. In the core component production method, the magnetic powder contained in the resin composition to be injection-molded is coated with the insulation material and thereafter the compression molded magnetic body or the compressed powder magnet molded body is insert-molded in the above-described resin composition. The present applicant obtained a patent for this production method (patent document 1).

Aiming at providing the composite magnetic core which can be arbitrarily shaped by using magnetic powder having a low moldability and which has a magnetic characteristic excellent in its DC superimposition characteristic and providing the magnetic element composed of this composite magnetic core and the coil wound around the composite magnetic core, the present applicant filed a patent application for the composite magnetic core composed of the combined body of the compression molded magnetic body obtained by compression molding magnetic powder and the injection molded magnetic body obtained by injection molding the magnetic powder, whose surface has been electrically insulated, to which binding resin is added. The injection molded magnetic body is used as the housing in which the compression molded magnetic body is disposed (patent document 2).

PRIOR ART DOCUMENTS

Patent Documents

Patent document 1: U.S. Pat. No. 4,763,609
Patent document 2: Japanese Patent Application Laid-Open Publication No. 2014-27050

SUMMARY OF THE INVENTION

Problem to be Solved by the Invention

In proportion to the value of electric current flowing through the coil, the size of the magnetic element to be used becomes larger. Thus the magnetic element has an unignorable problem that the magnetic element to be used for a large current generates heat owing to iron loss in addition to the copper loss-caused heat generation which has been a problem.

In a case where the magnetic body described in the patent document 1 or the magnetic body described in the patent document 2 is used as the magnetic body composing the magnetic element, the following problems occurred.

(1) Because the injection molded magnetic body has a higher degree of freedom than the compression molded magnetic body in terms of the configuration and size thereof, the injection molded magnetic body is capable of coping with the recent trend that the magnetic body is becoming large. But the injection molded magnetic body contains resin. Thus the injection molded magnetic body is inferior to the compression molded magnetic body in terms of thermal conductivity and specific heat. For example, in a pot-shaped magnetic element and an ER core, the injection molded magnetic body disposed far from a heat radiation surface and at the inside diameter side of the coil is liable to have a high temperature.

(2) The compression molded magnetic body is advantageous over the injection molded magnetic body in terms of the extent of heat generation and the heat dissipation performance. But unlike the injection molded magnetic body, it is difficult to produce the compression molded magnetic body having a complicated configuration. In addition, the production of the compression molded magnetic body causes production equipment to be larger in proportion to the size thereof and thus the production cost to increase. Because a large magnetic body is used for a large electric current, it is impossible to integrally form the compression molded magnetic body at a low cost. In a case where the compression molded magnetic body is produced splitly, it is necessary to use many kinds of dies and thus the production cost increases.

The present invention has been made to deal with the above-described problems. Therefore it is an object of the present invention to provide a magnetic element in which iron loss-caused heat generation is restrained and which can be produced with a high productivity.

Means for Solving the Problem

The magnetic element of the present invention has a coil and a magnetic body which allows a magnetic flux generated by the coil to pass therethrough. In the magnetic body, a compression molded magnetic body is disposed at a portion generating iron loss-caused heat to a high extent or a portion inferior in heat dissipation performance. An injection molded magnetic body is disposed at a portion other than the portion where the compression molded magnetic body is disposed, for example, a portion to be large-sized or a portion to be formed in a complicated configuration. The compression molded magnetic body and the injection molded magnetic body are combined with each other.

The coil is disposed inside the magnetic body. The compression molded magnetic body is disposed at an inside diameter side of the coil, whereas the injection molded magnetic body is disposed at an outside diameter side of the coil. The compression molded magnetic body is exposed to a surface of the magnetic body composed of the compression molded and injection molded bodies. Of the compression molded and injection molded magnetic bodies, at least the injection molded magnetic body is a combined body formed by combining two halves, of the injection molded magnetic body, obtained by bisection made in an axial direction of the coil with each other.

The compression molded magnetic body has a void portion inside the magnetic body composed of the compression molded and injection molded bodies.

Effect of the Invention

In the magnetic element of the present invention, by disposing the compression molded magnetic body at the portion generating the iron loss-caused heat to a high extent or the portion inferior in heat dissipation performance, it is possible to restrain the magnetic element from generating heat and hence protect the magnetic body and the insulation film of the coil.

By combining the compression molded magnetic body poor in its moldability with the injection molded magnetic body, it is possible to obtain a composite magnetic body having any desired configuration and excellent magnetic characteristic. As compared with a case in which the magnetic element is produced by insert molding, the magnetic element of the present invention allows the production equipment cost to decrease, the productivity thereof to be improved, the production cost to decrease, and the degree of freedom of configuration to be improved.

MODE FOR CARRYING OUT THE INVENTION

Figure 1:
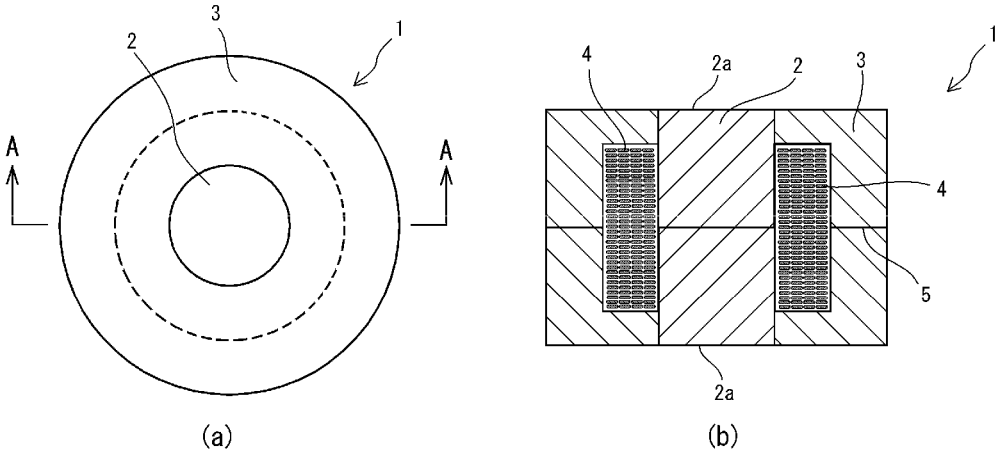
FIG. 1 shows an example of a pot-shaped magnetic element.

In the prevailing trend toward the application of large electric currents having higher frequencies to circuits of electrical and electronic equipment, a magnetic element using a ferrite material obtained by a compression molding method which currently prevails in molding methods is superior in its magnetic permeability and provides a high inductance value, but is inferior in its frequency characteristic and current superimposition characteristic. On the other hand, a magnetic element using an injection molded magnetic material containing an amorphous material is superior in its frequency characteristic and current superimposition characteristic, but is low in its magnetic permeability. The magnetic element for a large current has an unignorable problem that it generates heat owing to copper loss and also owing to iron loss. To cope with this problem, the present inventors have invented a magnetic element having a structure in which a compression molded magnetic body excellent in its heat conductance is disposed at a portion liable to generate heat or a portion where it is difficult to dissipate heat. In this structure, a large magnetic body large or a magnetic body having a complicated configuration is formed by molding an injection molding magnetic material. By combining the compression molded and injection molded magnetic bodies with each other, the magnetic element produced in this manner is restrained from generating heat and superior in its heat dissipation performance.

The magnetic element of the present invention can be preferably used as a pot-shaped magnetic element having a coil disposed inside the magnetic body. (1) Because the pot-shaped magnetic element has an advantage that it is provided with a magnetic path in such a way as to cover the coil, the leakage amount of a magnetic flux is allowed to be small. (2) Because the thickness of the magnetic body disposed at an outside diameter side of the coil is smaller than the radius of the magnetic body disposed at an inside diameter side of the coil, the pot-shaped magnetic element has another advantage that it is possible to make the configuration of the magnetic body small. But the pot-shaped magnetic element has a problem that at the inside diameter side of the coil, it is structurally difficult to dissipate heat generated in the magnetic body and the coil to the outside. To overcome this problem, the compression molded magnetic body is disposed at the inside diameter side of the coil. The compression molded magnetic body is so disposed that the compression molded magnetic body is exposed to the surface of the magnetic body composed of the compression molded and injection molded magnetic bodies. In addition, by bringing the compression molded magnetic body into contact with a cooling surface of a substrate or that of a housing, the present inventors have succeeded in accelerating the heat conduction performance at the inside diameter side of the coil where it is difficult to dissipate heat.

It is possible to use the following magnetic materials as the raw material for the compression molded magnetic body which can be used in the present invention. Examples of the magnetic raw material include a pure iron-based soft magnetic material such as iron powder and iron nitride powder; a ferrous alloy-based soft magnetic material such as Fe—Si—Al alloy (sendust) powder, super sendust powder, Ni—Fe alloy (permalloy) powder, Co—Fe alloy powder, and Fe—Si—B-based alloy powder; a ferrite-based magnetic material; an amorphous magnetic material; and a microcrystalline material.

Examples of the ferrite-based magnetic material include spinel ferrite having a spinel crystalline structure such as manganese zinc ferrite, nickel-zinc ferrite, copper zinc ferrite, and magnetite; hexagonal ferrite such as barium ferrite and strontium ferrite; and garnet ferrite such as yttrium iron garnet. Of these ferrite-based magnetic materials, the spinel ferrite which is a soft magnetic ferrite is preferable because it has a high magnetic permeability and a small eddy current loss in a high frequency domain.

Examples of the amorphous magnetic material include iron-based alloys, cobalt-based alloys, nickel-based alloys, and mixtures of these amorphous alloys.

Examples of oxides forming an insulation film on the surfaces of particles of soft magnetic metal powder to be used as the above-described raw materials for the compression molded magnetic body include oxides of insulation metals or semimetals such as $Al_2O_3$, $Y_2O_3$, MgO, and $ZrO_2$; glass; and mixtures of these substances.

As methods of forming the insulation film, it is possible to use a powder coating method such as mechanofusion, a wet thin film forming method such as electroless plating and a sol-gel method, and a dry thin film forming method such as sputtering.

The compression molded magnetic body can be produced by pressure-molding the above-described material powder having the insulation film formed on the surfaces of particles thereof or pressure-molding powder composed of the above-described material powder and thermosetting resin such as epoxy resin added thereto to obtain a compressed powder compact and thereafter by firing the compressed powder compact.

The average diameter of the particles of the material powder is favorably 1 to 150 μm and more favorably 5 to 100 μm. In a case where the average diameter of the particles of the material powder is less than 1 μm, the compressibility (a measure showing the hardenability of powder) of the material powder is low in a pressure-molding operation. Consequently the strength of the material for the compression molded magnetic body becomes outstandingly low after the compressed powder compact is fired. In a case where the average diameter of the particles of the material powder is more than 150 μm, the material powder has a large iron loss in a high frequency domain. Consequently the material powder has a low magnetic characteristic (frequency characteristic).

Supposing that the total of the amount of the material powder and that of the thermosetting resin is 100 percentages by mass, it is preferable to set the mixing ratio of the material powder to 96 to 100 percentages by mass. When the mixing ratio of the material powder is less than 96 percentages by mass, the mixing ratio thereof is low. Thus the material powder has a low magnetic flux density and a low magnetic permeability.

As a compression molding method, it is possible to use a method of filling the material powder into a die and press-molding the material powder at a predetermined pressure to obtain the compressed powder compact. A fired object is obtained by firing the compressed powder compact. In a case where amorphous alloy powder is used as the material for the compression molded magnetic body, it is necessary to set a firing temperature lower than the crystallization start temperature of the amorphous alloy. In a case where the powder to which the thermosetting resin has been added is used, it is necessary to set the firing temperature to a temperature range in which the resin hardens.

The injection molded magnetic body which can be used in the present invention is obtained by adding a binding resin to the material powder for the compression molded magnetic body and by injection-molding the mixture of the binding resin and the material powder.

It is preferable to adopt the amorphous metal powder as the magnetic powder because the amorphous metal powder allows the injection molding to be easily performed, the configuration of the injection molded magnetic body formed by the injection molding to be easily maintained, and the composite magnetic core to have an excellent magnetic characteristic.

As the amorphous metal powder, it is possible to use the above-described iron-based alloys, cobalt-based alloys, nickel-based alloys, and mixtures of these amorphous alloys. The above-described insulation film is formed on the surfaces of these amorphous metal powders.

As the binding resin, it is possible to use thermoplastic resin which can be injection-molded. Examples of the thermoplastic resin include polyolefin such as polyethylene and polypropylene, polyvinyl alcohol, polyethylene oxide, polyphenylene sulfide (PPS), liquid crystal polymer, polyether ether ketone (PEEK), polyimide, polyetherimide, polyacetal, polyether sulfone, polysulfone, polycarbonate, polyethylene terephthalate, polybutylene terephthalate, polyphenylene oxide, polyphthalamide, polyamide, and mixtures of these thermoplastic resins. Of these thermoplastic resins, the polyphenylene sulfide (PPS) is more favorable than the other thermoplastic resins because the polyphenylene sulfide (PPS) is excellent in its flowability in an injection molding operation when it is mixed with the amorphous metal powder, is capable of coating the surface of the resulting injection-molded body with a layer thereof, and is excellent in its heat resistance.

Supposing that the total of the amount of the material powder and that of the thermoplastic resin is 100 percentages by mass, it is preferable to set the mixing ratio of the material powder to 80 to 95 percentages by mass. In a case where the mixing ratio of the material powder is less than 80 percentages by mass, the material powder is incapable of obtaining the predetermined magnetic characteristic. In a case where the mixing ratio of the material powder exceeds 95 percentages by mass, the material powder causes the injection moldability to be inferior.

As the injection molding method, it is possible to use a method of injecting the material powder into a die consisting of a movable half thereof butted with a fixed half thereof. As the injection-molding condition, it is preferable to set the temperature of the resin to 290 to 350° C. and that of the die to 100 to 150° C. in the case of the polyphenylene sulfide (PPS), although the injection-molding condition is different according to the kind of the thermoplastic resin.

The compression molded and injection molded magnetic bodies are separately produced by the above-described methods and combined with each other. The former and the latter are so configured that they can be assembled easily and are suitable for compression molding and injection molding respectively. For example, in a case where a columnar magnetic body not having a central shaft hole is formed, a columnar configuration to be disposed at the inside diameter side of the coil is formed as the compression molded magnetic body by performing compression molding, whereas the outside diameter side of the coil is formed as the injection molded magnetic body by performing injection molding. Thereafter by press-fitting the columnar compression molded magnetic body into a hole formed at a central portion of the injection molded magnetic body, the columnar magnetic body is obtained. Alternatively with the compression molded magnetic body being disposed inside a die, the injection molded magnetic body is formed by insert molding. In this manner, the columnar magnetic body can be produced.

Of the compression molded and injection molded magnetic bodies to be combined with each other, it is preferable that at least the injection molded magnetic body is divided into two halves in the axial direction thereof in which the coil is inserted thereinto. Any bisecting method can be used so long as the coil is inserted into the injection molded magnetic body. It is preferable to axially divide the injection molded magnetic body into two halves. By dividing the injection molded magnetic body into the two halves, it is possible to decrease the number of dies. In a case where an adhesive agent is used to combine the two halves with each other, it is preferable to use a solventless type epoxy-based adhesive agent which allows the two halves to adhere to each other closely.

As a preferable combination of the material for the compression molded magnetic body and the material for the injection molded magnetic body, it is favorable that the material for the compression molded magnetic body is amorphous and that the material for the injection molded magnetic body is amorphous metal powder and the thermoplastic resin. It is more favorable to use Fe—Si—Cr-based amorphous alloy as the amorphous metal and the polyphenylene sulfide (PPS) as the thermoplastic resin.

The magnetic element of the present invention is composed of the compression molded magnetic body and a winding wound around the circumference thereof to form the coil having the function of an inductor. The magnetic element is incorporated in circuits of electrical and electronic equipment.

As the winding, a copper enamel wire can be used. It is possible to use a urethane wire (UEW), a formal wire (PVF), polyester wire (PEW), a polyester imide wire (EIW), a polyamideimide wire (AIW), a polyimide wire (PIW), a double coated wire consisting of these wires combined with one another, a self-welding wire, and a litz wire. The polyamideimide wire (AIW) and the polyimide wire (PIW) are preferable because these wires are excellent in the heat resistance thereof. It is possible to use the copper enamel wire round or rectangular in the sectional configuration thereof. By winding a minor diameter side of a rectangular wire in a sectional configuration around the compression molded magnetic body with the rectangular wire in contact with the circumference thereof in an overlapped state, a coil having an improved winding density is obtained. As a coil winding method, a helical winding method can be preferably adopted.

FIGS. 1 through 4 show one example of the magnetic element of the present invention.

FIG. 1(*a*) is a plan view of a pot-shaped magnetic element. FIG. 1 (*b*) is a sectional view taken along a line A-A shown in FIG. 1(*a*). In a pot-shaped magnetic element 1, a coil 4 is mounted inside a combined body of a compression molded magnetic body 2 and an injection molded magnetic body 3. The illustration of a terminal of the coil 4 is omitted herein. The combined body of the compression molded magnetic body 2 and the injection molded magnetic body 3 is divided into two halves along an intermediate line 5 disposed at an intermediate position in the axial direction of the pot-shaped magnetic element.

The compression molded magnetic body 2 is combined with the injection molded magnetic body 3 in such a way that the magnetic element 2 is disposed at the inside diameter side of the coil 4. An end surface 2*a* of the compression molded magnetic body 2 is exposed to a surface of the pot-shaped magnetic element 1. The exposed end surface 2*a* is brought into contact with a cooling surface of a substrate or the like. Thereby it is possible to accelerate heat conduction at the inside diameter side of the coil where it is difficult to radiate heat.

Figure 2:
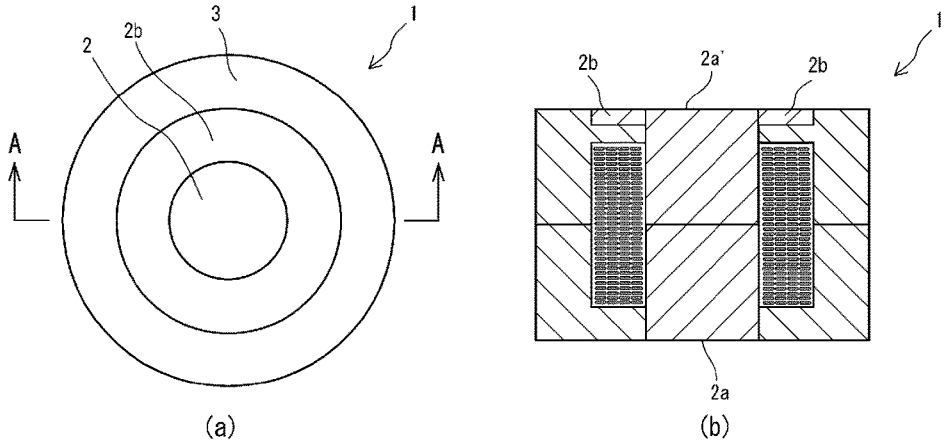
FIG. 2 shows an example of a pot-shaped magnetic element restrained in heat generation and improved in its heat dissipation performance.

FIG. 2 (*a*) is a plan view of a pot-shaped magnetic element in which the magnetic element shown in FIG. 1 is restrained from generating heat and improved in its heat dissipation performance. FIG. 2 (*b*) is a sectional view taken along a line A-A shown in FIG. 2(*a*).

By forming a compression molded magnetic body 2*b* on the periphery of an upper end surface 2*a*' of the compression molded magnetic body 2 remote from the end surface 2*a* which contacts the cooling surface, the coil 4 can be positively cooled.

Figure 3:
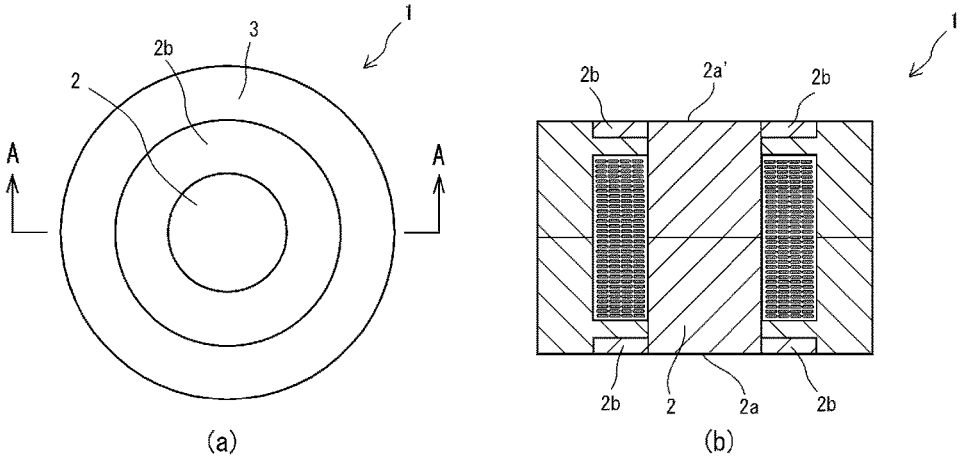
FIG. 3 shows an example of a pot-shaped magnetic element restrained in heat generation and improved in its heat dissipation performance to a higher extent.

FIG. 3(*a*) is a plan view of a pot-shaped magnetic element in which the magnetic element shown in FIG. 2 is restrained from generating heat and improved in its heat dissipation performance. FIG. 3(*b*) is a sectional view taken along a line A-A shown in FIG. 3(*a*).

By forming the compression molded magnetic body 2*b* on the periphery of the end surface 2*a* of the compression molded magnetic body which contacts the cooling surface, the area of the end surface 2*a* of the compression molded magnetic body which contacts the cooling surface is increased. Thereby the coil 4 can be positively cooled. In addition, because the upper and lower injection molded magnetic bodies have the same configuration, it is possible to decrease the number of dies and thus decrease the cost.

Figure 4:
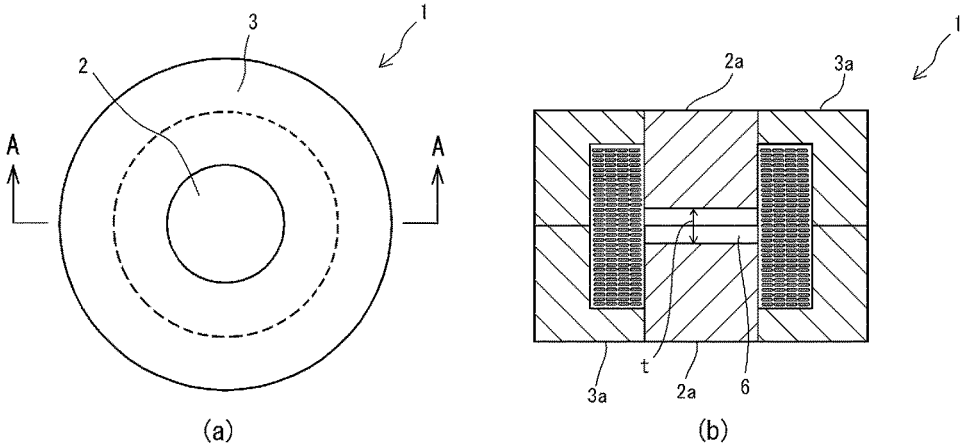
FIG. 4 shows an example of a pot-shaped magnetic element whose magnetic characteristic is adjustable.

FIG. 4 (*a*) is a plan view of a pot-shaped magnetic element adjustable in the magnetic characteristic of the magnetic element shown in FIG. 1. FIG. 4(*b*) is a sectional view taken along a line A-A shown in FIG. 4(*a*).

The coil 4 is mounted inside the pot-shaped magnetic element 1 which is the combined body of the compression molded magnetic body 2 and the injection molded magnetic body 3. The illustration of the terminal of the coil 4 is omitted herein. The combined body of the compression molded magnetic body 2 and the injection molded magnetic body 3 is divided into two halves along the intermediate line 5 disposed at the intermediate position in the axial direction of the pot-shaped magnetic element. The axial length of the compression molded magnetic body 2 is set shorter than that of the injection molded magnetic body 3. In addition, the end surface 2*a* of the compression molded magnetic body 2 and the end surface 3*a* of the injection molded magnetic body 3 are on the same plane. Therefore the compression molded magnetic body 2 has a void portion 6 therein. By adjusting the length t of the void portion 6, it is possible to control the characteristics of the pot-shaped magnetic element such as its saturation magnetic flux density.

Figure 5:
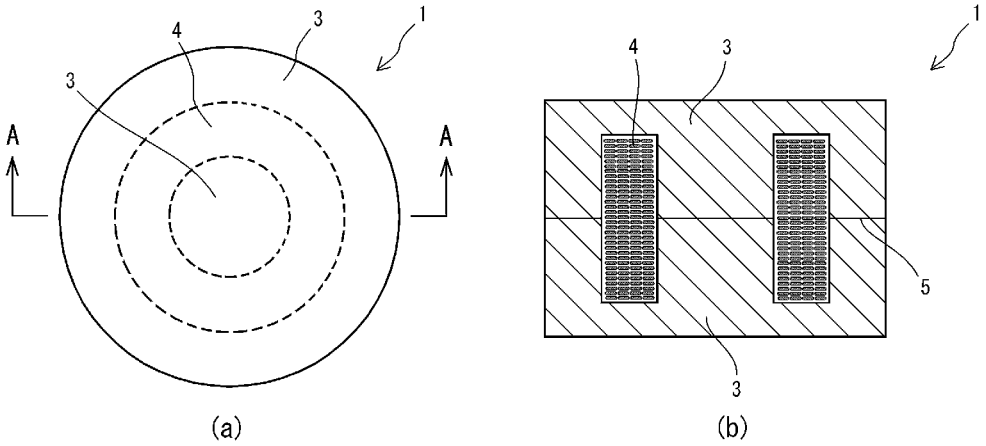
FIG. 5 shows a magnetic element of a comparative example.

FIG. 5 shows one example of a magnetic element of a comparative example. FIG. 5 shows an example in which the coil 4 is disposed inside the injection molded magnetic body 3. The injection molded magnetic body 3 is divided into two halves along the intermediate line 5 disposed at the intermediate position in the axial direction of the pot-shaped magnetic element. After the coil 4 is mounted inside the injection molded magnetic body 3, the two halves are combined with each other along the intermediate line 5. Thereby the pot-shaped magnetic element is obtained.

Figure 6:
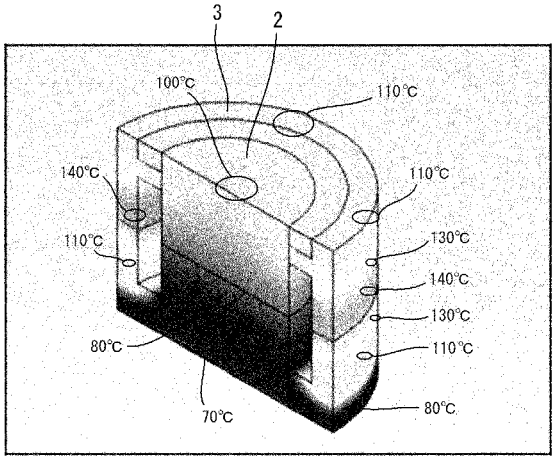
FIG. 6 shows a heat generation situation of the magnetic element shown in FIG. 1.
Figure 7:
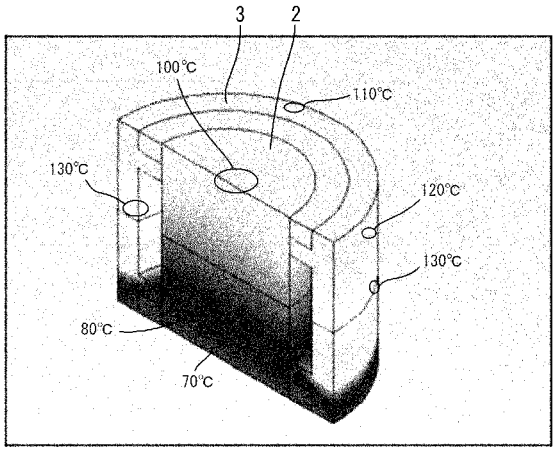
FIG. 7 shows a heat generation situation of the magnetic element shown in FIG. 3.
Figure 8:
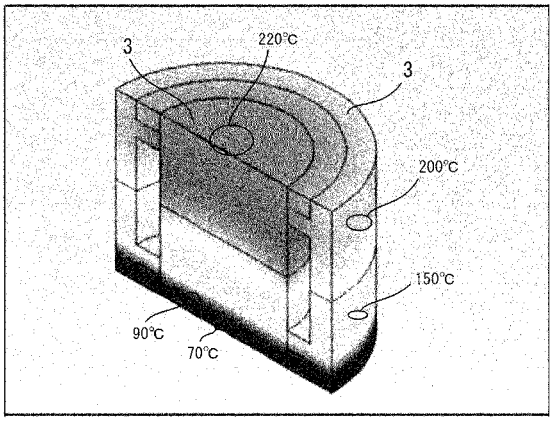
FIG. 8 shows a heat generation situation of the magnetic element shown in FIG. 5.

As one example, the heat generation situations of the magnetic elements were analyzed by performing coupled analysis of electromagnetic field analysis and thermal analysis by using a finite element method. The results are shown below. Specimens used in the test were the same in the configurations of the magnetic elements, the kinds of the coils, and the number of turns of the coils. The height of each columnar magnetic element used in the test was 30 mm. The diameter of each columnar magnetic element was 45 mm. The results are shown in FIGS. 6 through 8 which are perspective views of the magnetic elements circumferentially cut. FIG. 6 shows an example of the magnetic element shown in FIG. 1. FIG. 7 shows an example of the magnetic element shown in FIG. 3. FIG. 8 shows an example of the magnetic element shown in FIG. 5 as the comparative example. The illustration of the coils is omitted in FIGS. 6 through 8. A lower part of the magnetic element shown in FIGS. 6 through 8 is in contact with a cooling portion. In FIGS. 6 through 8, because the temperatures of respective portions are shown not in multicolor but in grayscale, the temperatures of elliptic regions and those of the peripheral portions of the pot-shaped magnetic elements are illustrated with numerals.

The pot-shaped magnetic elements shown in FIGS. 6 and 7 in which the compression molded magnetic body excellent in its thermal conductivity is disposed at the inside diameter side of the coil and the injection molded magnetic body is disposed at a portion other than the inside diameter side of the coil are capable of reducing the temperature on the periphery of the coil to a higher extent than the pot-shaped magnetic element, shown in FIG. 8, which is produced from only the injection molded magnetic body.

The magnetic element of the present invention can be used for power circuits of cars including a two-wheeled vehicle, industrial equipment, and medical equipment; filter circuits; switching circuits, and the like. For example, the magnetic element of the present invention can be used as an inductor, a transformer, an antenna, a choke coil, a filter, and the like. The magnetic element can be also used as surface mounting components.

INDUSTRIAL APPLICABILITY

Because the magnetic element of the present invention is capable greatly reducing iron loss and excellent in its heat dissipation performance, it is possible to efficiently operate electrical and electronic equipment in the future.

EXPLANATION OF REFERENCE NUMERALS AND SYMBOLS

1: pot-shaped magnetic element
2: compression molded magnetic body
3: injection molded magnetic body
4: coil
5: intermediate line
6: void portion

The invention claimed is:

1. A magnetic element comprising a coil; and a magnetic body which allows a magnetic flux generated by said coil to pass therethrough, said coil being disposed inside said magnetic body and enclosed in said magnetic body, wherein said magnetic element is pot-shaped, wherein in said magnetic body, a compression molded magnetic body is disposed at a portion that generates iron loss-caused heat to a high extent or a portion inferior in heat dissipation performance; and an injection molded magnetic body is disposed at a portion other than said portion where said compression molded magnetic body is disposed; and said compression molded magnetic body and said injection molded magnetic body are combined with each other, and wherein said compression molded magnetic body is columnar; said compression molded magnetic body is disposed at an inside diameter side of said coil; said injection molded magnetic body is disposed at an outside diameter side of said coil; said coil is formed by winding a winding onto said compression molded magnetic body; an entire periphery of said coil except a side thereof facing said compression molded magnetic body is completely covered by said injection molded magnetic body; and both end surfaces of a column which is said compression molded magnetic body are exposed to a surface of said magnetic body composed of said compression molded and injection molded bodies.

2. A magnetic element according to claim 1, wherein of said compression molded and injection molded magnetic bodies, at least said injection molded magnetic body is a combined body formed by combining two halves, of said injection molded magnetic body, obtained by bisection made in an axial direction of said coil with each other.

3. A magnetic element according to claim 1, wherein said compression molded magnetic body has a void portion inside said magnetic body composed of said compression molded and injection molded bodies.

4. A magnetic element according to claim 1, wherein another compression molded magnetic body is formed on a periphery of an end surface of said compression molded magnetic body which is exposed to a surface of said magnetic element so as to be exposed to a surface of said magnetic element.

5. A magnetic element according to claim 1, wherein said compression molded magnetic body is formed from amorphous metal powder and said injection molded magnetic body is formed from amorphous metal powder and thermoplastic resin.

* * * * *